US005943075A

United States Patent [19]

Lee et al.

[11] Patent Number: 5,943,075

[45] Date of Patent: Aug. 24, 1999

[54] UNIVERSAL FLUID DROPLET EJECTOR

[75] Inventors: Eric R. Lee, Redwood City; Martin L. Perl, Palo Alto, both of Calif.

[73] Assignee: The Board of Trustees of the Leland Stanford Junior University, Stanford, Calif.

[21] Appl. No.: 08/958,476

[22] Filed: Oct. 27, 1997

Related U.S. Application Data

[63] Continuation-in-part of application No. 08/908,333, Aug. 7, 1997.

[51] Int. Cl.[6] ..... B41J 2/045

[52] U.S. Cl. ..... 347/54; 239/102.2

[58] Field of Search ..... 239/4, 102.2, 135; 347/73, 74, 75, 76, 82, 47, 54, 9, 10, 68

[56] References Cited

U.S. PATENT DOCUMENTS

| | | | |
|---|---|---|---|
| 3,683,212 | 8/1972 | Zoltan | 310/8.3 |
| 5,124,716 | 6/1992 | Roy et al. | 347/11 |
| 5,619,234 | 4/1997 | Nagato et al. | 347/55 |

OTHER PUBLICATIONS

Savage, M. et al., *A search for fractional charges in native mercury,* Phys. Lett., vol. 167B, No. 4, 1986.

Joyce, D., M. S. Thesis, San Francisco State University, 1985.

*Primary Examiner*—Huan Tran

*Attorney, Agent, or Firm*—Lumen Intellectual Property Services

[57] ABSTRACT

A droplet generator comprises a fluid reservoir having a side wall made of glass or quartz, and an end cap made from a silicon plate. The end cap contains a micromachined aperture through which the fluid is ejected. The side wall is thermally fused to the end cap, and no adhesive is necessary. This means that the fluid only comes into contact with the side wall and the end cap, both of which are chemically inert. Amplitudes of drive pulses received by reservoir determine the horizontal displacements of droplets relative to the ejection aperture. The drive pulses are varied such that the dropper generates a two-dimensional array of vertically-falling droplets. Vertical and horizontal interdroplet spacings may be varied in real time. Applications include droplet analysis experiments such as Millikan fractional charge searches and aerosol characterization, as well as material deposition applications.

14 Claims, 4 Drawing Sheets

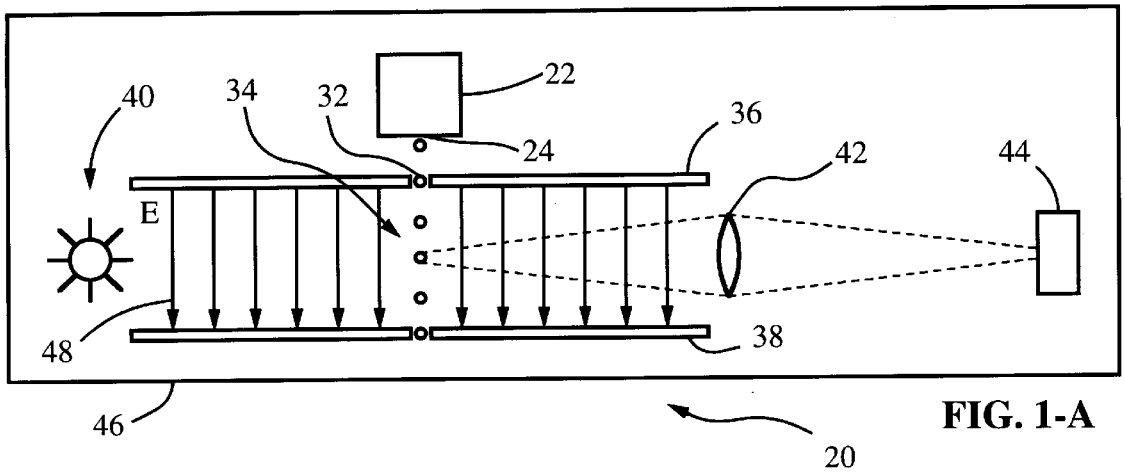
FIG. 1-A
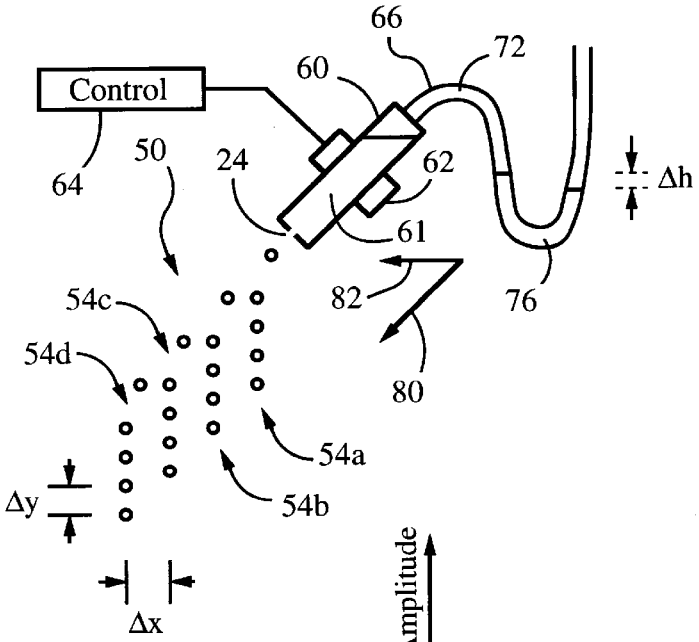
FIG. 1-B
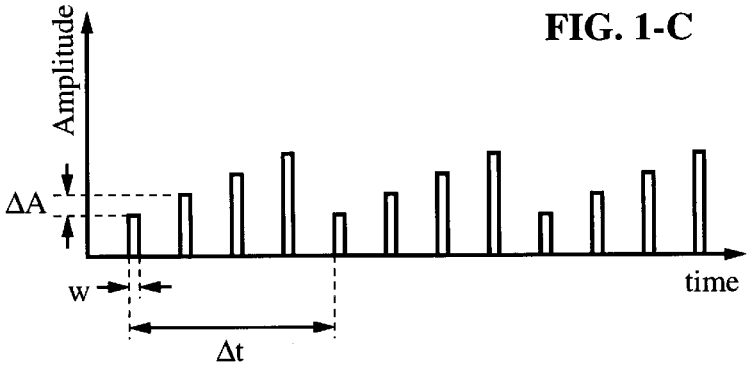
FIG. 1-C

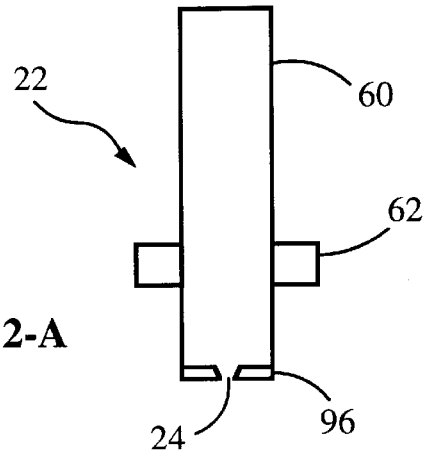
FIG. 2-A
FIG. 2-B
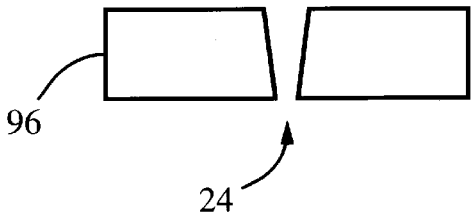
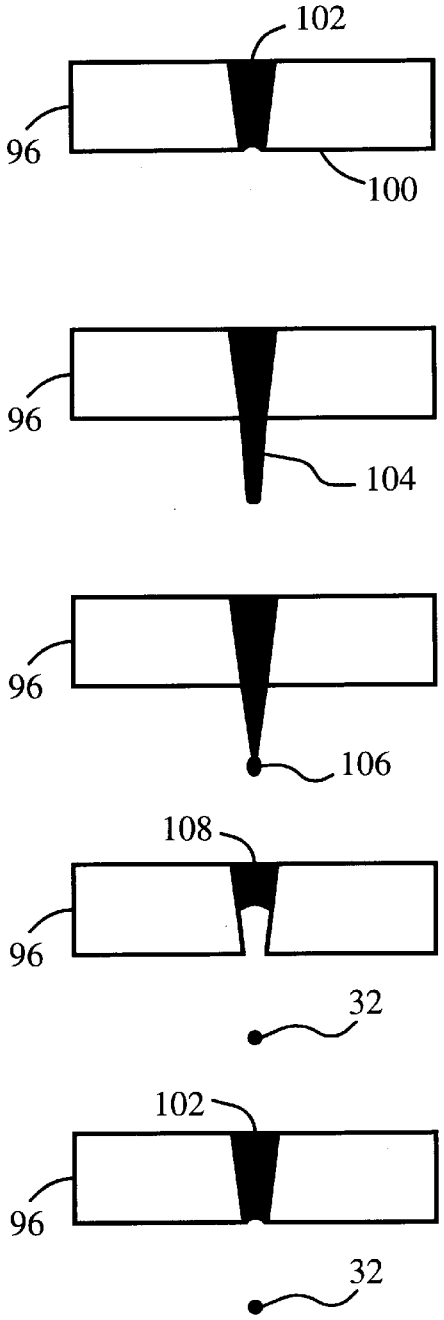
FIG. 3

UNIVERSAL FLUID DROPLET EJECTOR

RELATED APPLICATION DATA

This application is a continuation-in-part of application Ser. No. 08/908,333 filed Aug. 7, 1997.

This invention was made with U.S. Government support under grant No. DE-AC-03-76SF00515, awarded by the Department of Energy. The U.S. Government has certain rights in this invention.

FIELD OF THE INVENTION

This invention relates to droplet generation and analysis devices, and in particular to a droplet generator that is chemically and biologically inert.

BACKGROUND OF THE INVENTION

Droplet generation devices are used in a variety of analysis and characterization applications such as fractional charge searches in particle physics, aerosol characterization in chemistry, and cell-sorting techniques in biology. Such devices are also used in material deposition applications such as inkjet printing and microfabrication.

Droplet generators used in conventional analysis applications typically consist of a vertical dropper situated above an analysis chamber. The dropper generates a vertical stream of droplets which is optically analyzed as it falls through the analysis chamber. Depending on the application, the droplets may be subjected to electric fields, air currents, or other perturbations. For examples of droplet generators used for fractional charge searches see the article by Savage et al. in *Phys. Lett.* 167(B4):481 (1986), as well as the M.S. thesis of Joyce, San Francisco State University (1985).

Desirable properties for droppers used in analysis applications include: ability to adjust droplet sizes either electronically or by replacing a minimal amount of hardware, ease of replacement for droplet nozzles, ability to generate a large number of analyzable droplets, and chemical inertness of all tubing (including nozzle).

It is important to have a chemically non-reactive dropper. Typical droplet generators contain metal or plastic parts, and may therefore chemically react with or biologically contaminate the fluid under study. Zoltan, in U.S. Pat. No. 3,683,212, shows how to make a dropper that is chemically inert, using glass or other tubing that is necked down to form a nozzle through which droplets are ejected. However, manufacturing such a nozzle requires a highly skilled artisan, and no two nozzles will be identical. Furthermore, the tapering in such a nozzle is generally so gradual that the nozzle tends to clog easily.

Using a single nozzle for drop generation is desirable since it allows a significant reduction in total system cost, and in particular in nozzle replacement costs. Typical prior art single-nozzle systems are limited to generating a single stream of droplets, however, and therefore can only provide a limited amount of data within a given field of view of a camera.

Droplet generators used in conventional material deposition applications such as inkjet printing typically consist of a linear array of vertical nozzles situated closely above the deposition target (e.g. a sheet of paper). Each nozzle ejects droplets at a fixed location as the target moves relative to the array. The dropper array may be used to generate two-dimensional droplet arrays. The requirement for placing the nozzles in close proximity to the target makes imaging the impact points of the droplets relatively difficult. For information on droplet generators used for inkjet printing see for example U.S. Pat. Nos. 5,124,716, 3,683,212, and 5,619,234.

OBJECTS AND ADVANTAGES OF THE INVENTION

In light of the above, it is a primary object of the present invention to provide an easily manufactured and easily reproduced droplet generator that is chemically inert and biologically sterile. It is also an object of the invention to provide a droplet analysis apparatus capable of using a single nozzle to generate a large amount of analyzable data within the field of view of an analysis camera. It is another object of the invention to provide an apparatus capable of modulating in real time the vertical and horizontal inter-droplet spacings of a two-dimensional droplet array. It is another object of the invention to provide a deposition system allowing for easy visualization of droplet impact points on deposition targets.

SUMMARY OF THE INVENTION

The present invention provides an improved apparatus for generating droplets. The apparatus comprises a liquid reservoir, an ejection means coupled to the reservoir, and a control means in electrical communication with the ejection means, for controlling the ejection means.

The liquid reservoir has a side wall made of a silicon-containing compound, such as quartz or glass, and an end cap comprising a silicon plate. This end cap has a micromachined aperture through which liquid droplets are ejected. The end cap is bonded to the reservoir body by a thermal weld.

The ejection means generates pressure pulses within the reservoir such that the reservoir ejects droplets through the ejection aperture. The droplets are ejected in a direction having a horizontal component. The pressure pulses, and in particular their amplitudes, determine horizontal displacements of the droplets relative to the ejection aperture. The pressure pulses are controlled by drive pulses generated by the control means and received by the ejection means. The control means generates drive pulses of various amplitudes, such that the reservoir ejects droplets at various horizontal displacements.

The ejection means does not physically touch the fluid, and the bond between the side wall and the end cap of the reservoir requires no adhesive; therefore the fluid contacts only the side wall and end cap materials. These materials will not contaminate biological samples, nor will they react chemically with most substances. Furthermore, because the ejection aperture is micromachined, the dropper is easily manufactured and reproduced. The present invention therefore provides an economical and reproducible fluid droplet ejector that is universal in the sense that it can employ a wide variety of fluids.

DESCRIPTION OF THE FIGURES

FIG. 1-A shows a side view of a preferred apparatus including a dropper of the present invention.

FIG. 1-B shows the dropper of FIG. 1-A and a two-dimensional droplet array generated by the dropper, in a side view orthogonal to the view of FIG. 1-A.

FIG. 1-C shows a driving pulse sequence used to generate part of the droplet array of FIG. 1-B.

FIG. 2-A shows a longitudinal sectional view of the dropper of FIG. 1-B.

FIG. 2-B shows a longitudinal sectional view of the end cap of the dropper of FIG. 2-A.

FIG. 3 shows the end cap of FIG. 2-B as a droplet is ejected through the dropper aperture.

DETAILED DESCRIPTION

Figure 4:
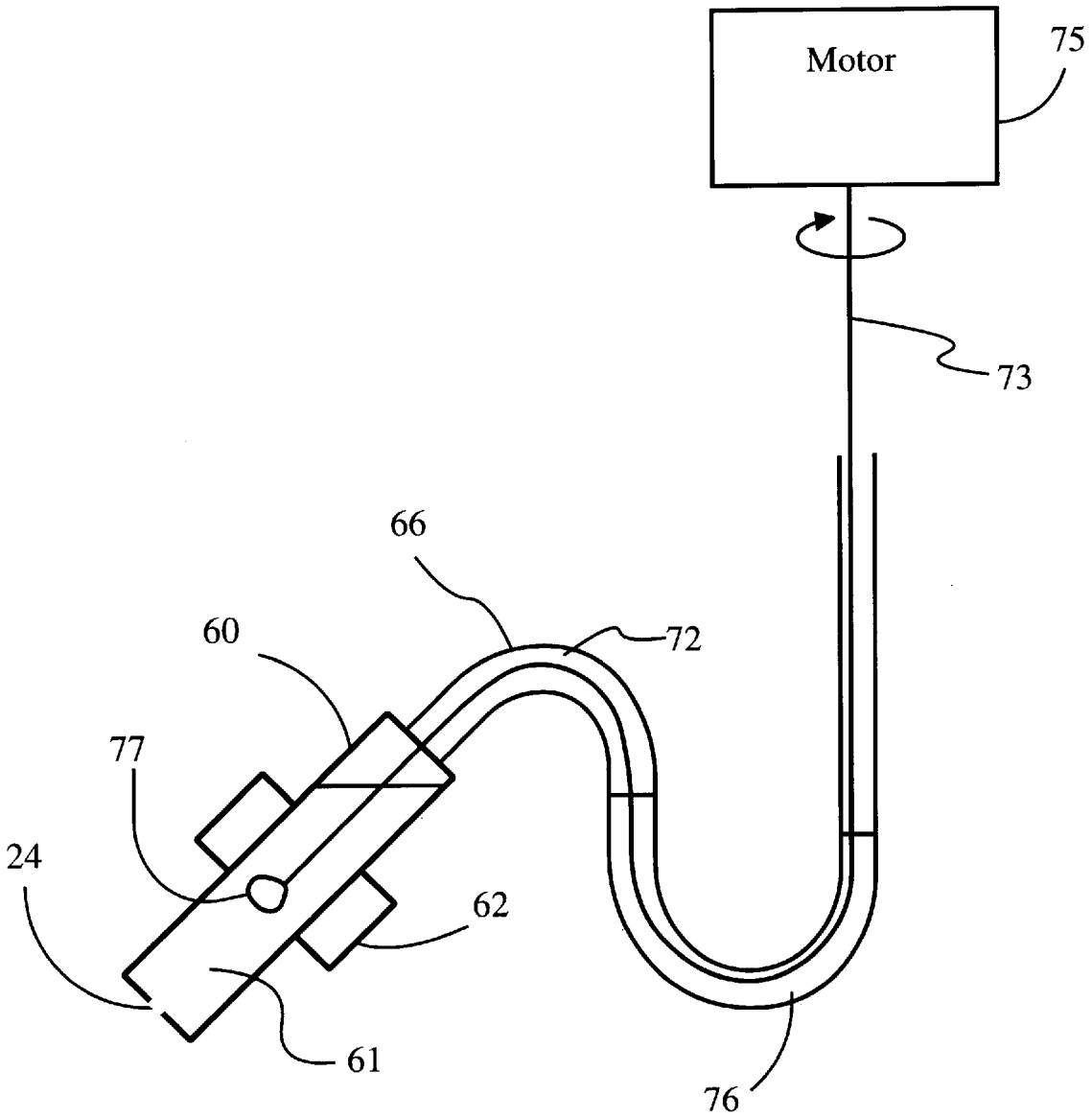
FIG. 4 shows an alternative embodiment of the dropper including a mechanical stirring means.

FIG. 1-A shows a side schematic view (not to scale) of a preferred apparatus 20 of the present invention, suitable for droplet analysis applications and in particular for charge measurement (e.g. Millikan oil drop) experiments. Apparatus 20 comprises a dropper 22 having an ejection aperture 24 for ejecting liquid droplets 32. Ejection aperture 24 is situated above aligned slits in an upper plate 36 and lower plate 38. Upper plate 36 and lower plate 38 are parallel and horizontal, and are connected to a voltage source (not shown) for generating a potential difference between upper plate 36 and lower plate 38. The space between upper plate 36 and lower plate 38 comprises an analysis area 34. A housing 46 defines a convection-free enclosure comprising analysis area 34, such that the trajectories of droplets 32 are not affected by air currents. A light source 40, preferably a strobe, is positioned laterally with respect to analysis area 34, and is capable of illuminating analysis area 34. A CCD camera 44 and imaging optics (including a lens 42) are situated opposite light source 40 relative to analysis area 34, such that droplets 32 within analysis area 34 are imaged onto camera 44. Light source 40, dropper 22, and camera 44 are in electrical communication with control electronics (not shown) situated outside housing 46.

A potential difference between upper plate 36 and a lower plate 38 generates a uniform vertical electric field 48 within analysis area 34. Electric field 48 oscillates in time as a square wave. Droplets 32 enter and exit an analysis area 34 through slits in upper plate 36 and lower plate 38. Droplets 32 within analysis area 34 are illuminated by light source 40 and are imaged through lens 42 onto CCD camera 44. The vertical velocities of droplets 32 are indicative of the electric charge on droplets 32.

FIG. 1-B shows dropper 22 and a two-dimensional droplet array 50 generated by dropper 22, from a side view orthogonal to the view of FIG. 1-A. Dropper 22 comprises a fluid reservoir having a side wall 60. The reservoir holds dropper fluid 61. An ejection means 62 is coupled to side wall 60 and laterally encloses side wall 60. Ejection means 62 comprises a piezoelectric disk for constricting side wall 60. Ejection means 62 is in electrical communication with control electronics 64. Ejection means 62 constricts the fluid reservoir in response to the drive pulses, generating pressure pulses within the fluid reservoir. The pressure pulses cause the ejection of the droplets forming array 50.

A manometer tube 66 is connected to the fluid reservoir at the end opposite aperture 24, for controlling the global pressure within the fluid reservoir. Tube 66 encloses an inert gas volume 72 adjacent to the fluid reservoir, and a U-shaped liquid column 76 adjacent to the inert gas 72. In the preferred embodiment, the end of manometer tube 66 opposite the fluid reservoir is open to the air. In an alternative embodiment, this end is connected to a regulator that maintains a constant pressure above liquid column 76.

The inert gas 72 may be any gas which does not react with dropper fluid 61; depending on the application, the inert gas may be air or a noble gas.

The lowest point of manometer tube 66 can be adjusted to cause a level difference $\Delta h$ between the two surfaces of column 76, which in turn causes a slightly negative pressure to be applied to the fluid reservoir. The negative pressure prevents the escape of dropper fluid 61 through aperture 24 in the absence of a drive pulse. Meniscus buildup and subsequent liquid escape is also impeded by the horizontal orientation of dropper 22. Liquid escape can cause wetting of the surface surrounding aperture 24.

Droplets 32 are ejected through aperture 24 along an ejection direction 80 having a horizontal component 82. The ejection direction is preferably at approximately 45° from the horizontal; alternatively, the ejection direction may be horizontal. Shortly after ejection, the horizontal velocities of droplets 32 are dampened by air friction, and droplets 32 fall vertically downward with a constant velocity determined by Stokes' Law. For droplets having non-zero charge, the terminal velocity depends on whether electric field 48 opposes or reinforces the gravitational force on the droplets. The two-dimensional droplet array 50 generated by dropper 22 comprises a rectangular array portion consisting of parallel falling droplet streams 54*a–d*. Streams 54*a–d* are separated by horizontal interdroplet spacings $\Delta x$, while droplets within a single stream are separated by vertical interdroplet spacings $\Delta y$.

The horizontal and vertical interdroplet spacings are controlled by the drive pulses received by ejection means 62. FIG. 1-C illustrates three consecutive sequences of drive pulses generated by control means 64 and received by ejection means 62. The vertical interdroplet spacing between two consecutive droplets in a vertical stream is determined by the time difference $\Delta t$ between the drive pulses corresponding to the two droplets. The horizontal spacing between droplets in adjacent streams is determined by the difference in amplitude $\Delta A$ between the drive pulses corresponding to the two streams. The pulse width of the pulses is marked w. The drive pulse amplitudes determine the initial horizontal droplet velocities and the location of the droplet break-off points (see below), thus determining the horizontal droplet displacements at any given time point.

FIG. 2-A is a longitudinal sectional view of dropper 22, showing ejection means 62 and side wall 60. Side wall 60 is preferably a glass tube; it may also be made of quartz. Quartz is chemically inert to most substances including strong acids and bases; glass is slightly more reactive but is easier to use. Ejection means 62 preferably comprises an annular piezoelectric transducer disk made from lead zirconate titanate, and attached to side wall 60 with epoxy or another high-strength adhesive. An end cap 96 comprising aperture 24 is made of silicon, and is attached to the bottom of side wall 60 by thermal welding. This weld is achieved by heating up the side wall 60 and the end cap 96, while they are in contact with each other, to approximately 600° C. We have found an ordinary propane torch to be sufficient for this purpose. The weld will form because silicon end cap 96, when exposed to air, develops a thin layer of silicon dioxide on its surface. It is this layer that fuses with the glass (or quartz) side wall. If desired, a layer of silicon dioxide could be applied to end cap 96 using thin film deposition techniques; however, we have not found this step to be necessary.

FIG. 2-B shows a longitudinal cross section of end cap 96. Aperture 24 has an inverted pyramidal or conical shape, and is made by micromachining silicon end cap 96. The use of micromachined silicon allows dropper 22 to be easily manufactured and easily duplicated. Moreover, the angle of tapering of aperture 24 can be made shallow enough that aperture 24 is resistant to jamming by, for example, stray particles suspended in fluid 61. The combined use of silicon and glass (both chemically inert) in the absence of metal, plastics, or adhesives in contact with the fluid allows the ejection of high-temperature fluids, corrosives, and biological samples requiring high sterility.

FIG. 3 illustrates end cap 96 as a droplet is generated by dropper 22. A liquid volume 102 is initially in a resting state within aperture 24. Slightly negative pressure acting on liquid volume 102 maintains liquid volume 102 within aperture 24, and prevents the wetting of a bottom surface 100 of end cap 96. As a pressure pulse is applied by ejection means 62, a liquid extension 104 stretches outward from aperture 24. A droplet 25 precursor 106 forms as liquid starts retracting toward aperture 24. Droplet precursor 106 becomes a drop 32 as liquid 108 becomes fully retracted in aperture 24, as a result of the negative pressure wave caused by the relaxation of ejection means 62. The breaking point of droplet 32 is 30 determined by the amplitude of the drive pulse received by ejection means 62. During the retraction of the fluid, air does not become trapped within aperture 24. Liquid from the fluid reservoir of dropper 22 then enters aperture 24 from the top, restoring the resting-state liquid volume 102.

FIG. 4 shows another embodiment including means for stirring the dropper fluid 61. The stirring means comprises a filament 73, which can be a thin TEFLON (polytetrafluoroethylene) tube, a wire, or any object that is both longer and thinner than manometer tube 66 and that can transfer mechanical force. Preferably, filament 73 is made of a chemically non-reactive material. Filament 73 is threaded through manometer tube 66. A first end of filament 73 is connected to motor 75; a second end dips into dropper fluid 61 10 and is tied into a loop 77. Alternatively, loop 77 may be replaced by a knot or a small piece of chemically inert material tied to the second end of filament 73. In yet another embodiment, the second end of filament 73 is flattened into a paddle shape. Motor 75 rotates filament 73, thereby stirring dropper fluid 61. Alternatively, motor 75 could provide a back-and-forth motion to the filament; this motion also causes the dropper fluid to be stirred.

In another embodiment of this stirring means, filament 73 is fitted into a sleeve of TEFLON (polytetrafluoroethylene) or other low friction material, so that the filament may move smoothly without hitting the side walls of manometer tube 66. In this embodiment, the second end of filament 73 protrudes out from the sleeve and into the dropper fluid; the sleeve-and-filament combination catheterizes manometer tube 66.

Figure 5:
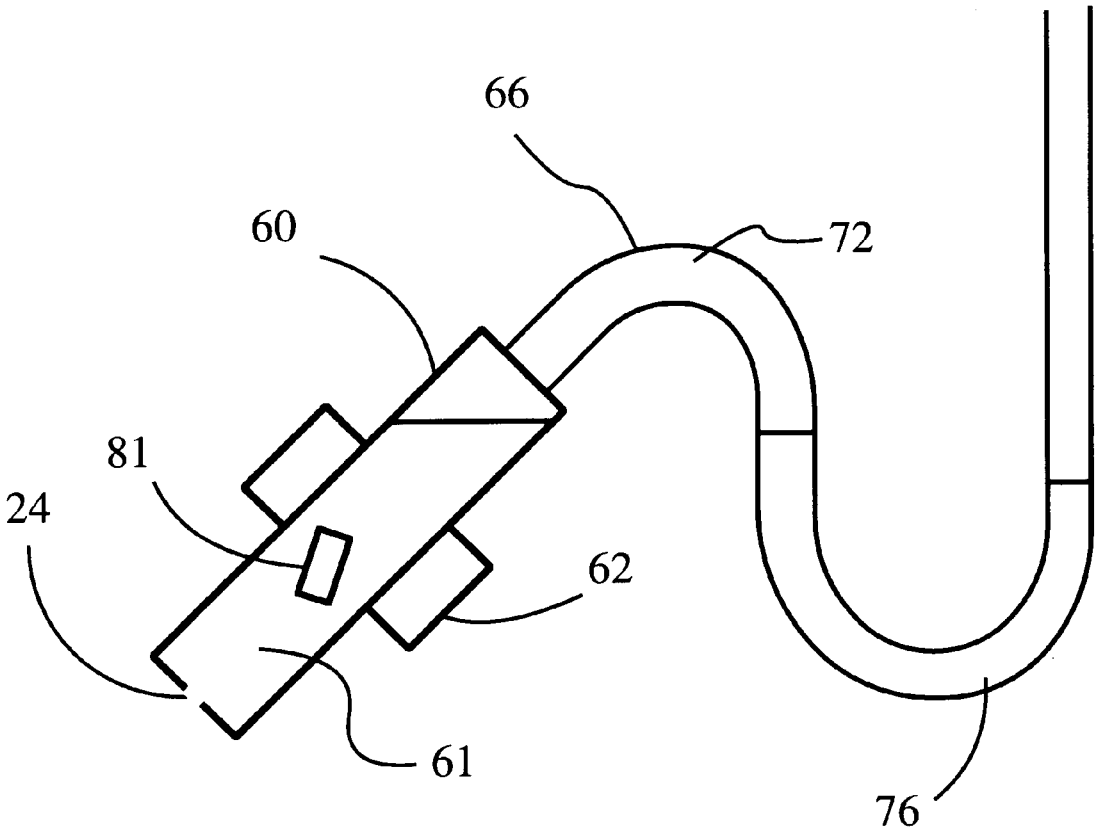
FIG. 5 shows an alternative embodiment of the dropper including a magnetic stirring means.

Another stirring means is shown in FIG. 5. A magnet 81 is placed inside the fluid reservoir. Preferably the magnet is coated with teflon or other unreactive material. A varying magnetic field is then applied to the reservoir, causing the magnet inside to rotate, nutate, or otherwise move so that it stirs the dropper fluid.

The advantage of including stirring means is that one may then use a dropper fluid that comprises a carrier fluid and a test material suspended in, but not dissolved in, the carrier fluid.

Generating clean droplets (without spray) of uniform and small (~10 $\mu$m) size typically requires optimizing regime parameters for dropper 22. To optimize system settings, a drive pulse amplitude corresponding generally to desired horizontal displacements is selected. The drive pulse width is varied until dropper 22 produces clean drops of uniform size. The drive pulse amplitude is then varied for a fixed pulse width setting to find the operating amplitude range in which dropper 22 does not produce spray. If the operating amplitude range is not satisfactory for attaining desired horizontal interdroplet spacings, the drive pulse width is again varied to a point corresponding to clean droplets. The pulse rise- and fall-times, and the instantaneous pressure applied by manometer 68 also affect droplet stability, and may all be varied during the optimization procedure. For a double pulse technique, in which each drive pulse consists of two closely separated (tens of microseconds) spikes, the interspike separation may also be varied in the initial optimization step, until clean drops are generated.

The present invention does not require that the force field acting on the droplets be vertical. More generally, a field (e.g. a combined electric and gravitational field) of arbitrary direction may be used to apply a force on the droplets. The ejection direction then has a component along a direction orthogonal to the applied field. Pressure pulses then determine droplet displacements along the orthogonal direction, relative to the ejection aperture.

A dropper of the present invention is not limited to droplet analysis applications, and may be used for material deposition applications. In such applications, a position adjustment means may be used to adjust the dropper position relative to a target deposition area. The position adjustment means may include a x-y or linear stage on which the dropper is mounted, and/or a rotational means allowing rotation of the dropper about vertical and/or horizontal axes.

Applications of the present invention include the generation of aerosols for their study, weighing macromolecules incorporated in the droplets, microfabrication by accretion of material contained within the droplets, optical analysis of materials, and analysis of convection patterns.

It will be clear to one skilled in the art that the above embodiments may be altered in many ways without departing from the scope of the invention. For example, droplet horizontal displacements need not be controlled by varying drive pulse amplitudes, but may generally be controlled by varying pulse widths or other parameters. Suitable droplet sizes range from about 5 $\mu$m to about 100 $\mu$m. While droplet sizes are defined to some extent by ejection aperture diameters, pulse widths and amplitudes may be used to vary droplets sizes droplet sizes within a factor of two of the aperture diameter.

The ejection means may also occur in different embodiments. While a piezoelectric ejection means is desirable because of its low cost, low heat generation, low power requirements, and ease of integration with the fluid reservoir, other ejection means may generally be used in the present invention. Suitable ejection means may include devices using acoustic excitation from focused ultrasound, a focused optical beam that can create a bubble in the fluid, electrostatic constriction or repulsion, electromagnetic actuation, electrothermal pulse generation, or purely mechanical or pneumatic methods of generating pressure pulses.

In yet another ejection means embodiment, the manometer tube is configured to give a positive, rather than negative pressure to the fluid reservoir, creating a steady stream of ejected fluid. This stream is however modified by applying an oscillating force to the exterior of the fluid reservoir, using, for example, a piezoelectric device. The oscillations set up a wave in the stream of ejected fluid; the nodes of this wave correspond to the separation between the drops.

In view of these possible variations, the scope of the invention should be determined by the following claims and their legal equivalents.

We claim:

1. A method for making fluid droplets, comprising the steps of:

a) causing a layer of silicon dioxide to form on a surface of a silicon plate, b) micromachining an aperture in said plate, c) thermally fusing said plate to a first end of a tube, thereby capping said first end of tube, said tube comprising a compound comprising silicon, d) pouring a fluid into said tube through a second end of said tube, e) applying a plurality of pressure pulses to said fluid using an ejection means for applying pressure pulses and a control means for sending drive pulses to said ejection means;

whereby droplets of said fluid are ejected from said tube through said aperture.

2. The method of claim 1, wherein said silicon-comprising compound is glass.

3. The method of claim 1, wherein said silicon-comprising compound is quartz.

4. The method of claim 1, additionally comprising the step of attaching a piezoelectric device to the exterior of said tube, and wherein applying said pressure pulses comprises the step of supplying a varying electric current to said piezoelectric device.

5. The method of claim 1, further comprising the step of stirring said fluid while said fluid is in said tube.

6. The method of claim 1, further comprising the step of controlling a global pressure in said tube.

7. The method of claim 1, wherein causing said silicon dioxide layer to form comprises the step of exposing said plate to air.

8. The method of claim 1, wherein causing said silicon dioxide layer to form comprises the step of using thin film deposition techniques.

9. A chemically unreactive fluid dropper comprising:

a) a fluid;

b) a fluid reservoir for holding said fluid, said reservoir comprising:

(i) a side wall of a silicon-comprising compound having a surface layer comprising silicon dioxide, and (ii) an end cap comprising a silicon plate having a micromachined aperture, said end cap being thermally welded to said side wall across said surface layer;

c) an ejection means for producing pressure pulses in said fluid; and d) a control means in electrical communication with said ejection means, for sending drive pulses to said ejection means;

whereby said fluid is ejected from said reservoir through said aperture by the pressure pulses produced by said ejection means.

10. The apparatus of claim 9, wherein said silicon-comprising compound is glass.

11. The apparatus of claim 9, wherein said silicon-comprising compound is quartz.

12. The apparatus of claim 9, wherein said ejection means comprises a piezoelectric device mounted on the exterior of said side wall.

13. A chemically unreactive fluid dropper comprising:

a) a fluid;

b) a fluid reservoir for holding said fluid, said reservoir comprising:

(i) a side wall of a silicon-comprising compound, and (ii) an end cap comprising a silicon plate having a micromachined aperture, said end cap being thermally welded to said side wall;

c) a means for stirring said fluid;

d) an ejection means for producing pressure pulses in said fluid; and e) a control means in electrical communication with said ejection means, for sending drive pulses to said ejection means;

whereby said fluid is ejected from said reservoir through said aperture by the pressure pulses produced by said ejection means.

14. A chemically unreactive fluid dropper comprising:

a) a fluid;

b) a fluid reservoir for holding said fluid, said reservoir comprising:

(i) a side wall of a silicon-comprising compound, and (ii) an end cap comprising a silicon plate having a micromachined aperture, said end cap being thermally welded to said side wall;

c) a means for controlling a global pressure in said reservoir;

d) an ejection means for producing pressure pulses in said fluid; and e) a control means in electrical communication with said ejection means, for sending drive pulses to said ejection means;

whereby said fluid is ejected from said reservoir through said aperture by the pressure pulses produced by said ejection means.

* * * * *